US005507349A

United States Patent [19]

Wray et al.

[11] Patent Number: 5,507,349

[45] Date of Patent: Apr. 16, 1996

[54] DOWNHOLE COILED TUBING LATCH

[75] Inventors: Gary Q. Wray; James C. Tucker; K. Gregory Neal, all of Duncan, Okla.

[73] Assignee: Halliburton Company, Duncan, Okla.

[21] Appl. No.: 359,260

[22] Filed: Dec. 19, 1994

[51] Int. Cl.[6] ..... E21B 23/02; E21B 23/04; E21B 47/00; E21B 17/20

[52] U.S. Cl. ..... 166/382; 166/77.2; 166/383; 166/384; 175/320; 285/320; 285/83

[58] Field of Search ..... 166/382, 384, 166/385, 65.1, 77; 175/320, 40; 285/320, 306, 83, 102

[56] References Cited

U.S. PATENT DOCUMENTS

| | | | |
|---|---|---|---|
| 3,339,947 | 9/1967 | Maisey | 285/320 X |
| 4,337,971 | 7/1982 | Kendrick | 285/320 X |
| 4,484,628 | 11/1984 | Lanmon, II | 166/383 X |
| 4,488,597 | 12/1984 | Hoppe et al. | 166/385 X |
| 4,730,851 | 3/1988 | Watts | 285/320 |
| 4,844,159 | 7/1989 | Airey et al. | 166/385 X |

*Primary Examiner*—Stephen J. Novosad
*Attorney, Agent, or Firm*—Stephen R. Christian; Neal R. Kennedy

[57] ABSTRACT

A downhole coiled tubing latch for positive latching to a drill pipe while pumping fluids. The apparatus comprises a housing positioned in the drill pipe with a slidable mandrel positioned in the housing. The apparatus further comprises a latch stinger which can be lowered on a coiled tubing and sealingly engaged with the mandrel and the housing. When weight is set down, the stinger and mandrel are moved downwardly which actuates latch fingers on the mandrel which latchingly engage a groove on the stinger to positively hold the stinger in place while fluids are pumped therethrough. One or more pressure balance pistons are used to help hold the apparatus in a latched position when pressure is applied. When weight is picked up, a spring returns the mandrel to the unlatched position so that the stinger may be removed.

24 Claims, 10 Drawing Sheets

DOWNHOLE COILED TUBING LATCH

BACKGROUND OF THE INVENTION

1. Field of the Invention

This invention relates to downhole tools used for pumping fluids in drill pipe, wherein the drill pipe does not usually provide a reliable pressure seal, and more particularly to a latch usable on coiled tubing and adapted for positively latching to a special drill pipe section with a pressure seal.

2. Description of the Prior Art

There is a regular need for pumping fluids downhole in drill pipe. Frequently, there is also a need for this to be carried out with a reliable pressure seal between the drill pipe and the tool used to pump the fluid. One example of such a need is when performing microfracs where pressure and fluid loss is unacceptable.

A problem with some prior art tools is that the tubing pressure tends to pump the tool out of the drill string. The present invention solves this problem by providing a pressure balanced downhole coiled tubing latch so that the tubing pressure does not force the latch upwardly.

More specifically, the downhole coiled tubing latch of the present invention solves the problem of the prior art by providing a stinger which positively latches with a matching latch housing run in as part of the drill pipe workstring. The downhole coiled tubing latch further provides a positive pressure seal between the stinger and latch housing.

SUMMARY OF THE INVENTION

The downhole coiled tubing latch of the present invention is adapted to be latched into a drill pipe so fluids may be pumped therethrough without tending to pump the tool out of the drill pipe. The invention is thus a downhole apparatus and comprises housing means for connecting to the drill pipe, stinger means for positioning in the housing means and allowing pumping of fluid therethrough, and latching means for latching the stinger means to the housing means when the stinger means is moved downwardly in the housing means.

The latching means comprises a mandrel slidably disposed in the housing means, and a latch finger pivotally disposed on the mandrel and adapted for latchingly engaging a latching groove on the stinger means. The latch finger comprises a lug thereon for extending into the latching groove when in a latched position.

The apparatus further comprises biasing means for biasing the mandrel port toward an unlatched position. In the preferred embodiment, the biasing means comprises a shoulder on the mandrel, another shoulder on the housing means, and a spring disposed between the two shoulders.

A piston is provided on the mandrel as a portion thereof for providing a downward force on the mandrel to help hold it in the latched position when pressure is applied to the piston. The piston is in fluid communication with the central opening through the stinger means. One or more of such pistons may be used.

The apparatus further comprises sealing means for sealing between the stinger means and the mandrel. Because of the latching engagement between the latch fingers and the stinger means, the sealing means is constantly engaged when fluid is pumped through the stinger means.

The stinger means is preferably adapted for attachment to a coiled tubing string, but may be positioned in the drill pipe in other ways as well, and the invention is not intended to be limited to a coiled tubing device.

The present invention also includes a method of pumping fluid through a drill pipe in a well bore comprising the steps of positioning a latch housing in the drill pipe with a slidable latch mandrel slidably diposed in the latch housing, positioning a stinger in the latch housing and mandrel, setting down weight on the stinger to apply an axial force for moving the stinger and mandrel in the latch housing, and latchingly engaging the mandrel and stinger to one another in response to such movement. The method may also comprise the step, of applying fluid pressure to a piston on the mandrel to provide a force for preventing pumping of the mandrel upwardly. The method may further comprise the step of biasing the mandrel so that the mandrel and stinger are moved back to the unlatched position when weight is picked up on the stinger. An additional step may be included of sealing between the stinger and mandrel when they are latched.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1A:
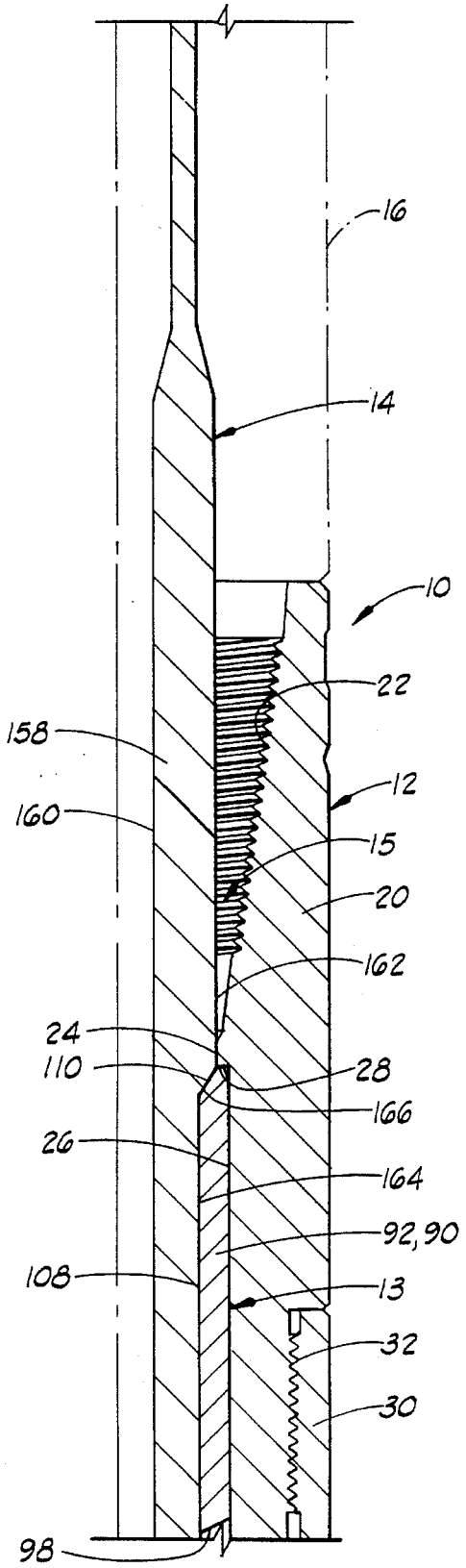
FIGS. 1A–1F illustrate a longitudinal cross section of the downhole coiled tubing latch of the present invention, showing the tool in a disengaged or unlatched position.

Referring now to the drawings, and more particularly to FIGS. 1A–1F, the downhole coiled tubing latch apparatus of the present invention is shown and generally designated by the numeral 10. Apparatus 10 generally comprises a latch housing 12 with a mandrel assembly 13 therein and a latch stinger 14. Latch housing 12 defines a central opening 15 therethrough in which mandrel assembly 13 is positioned.

Figure 1B:
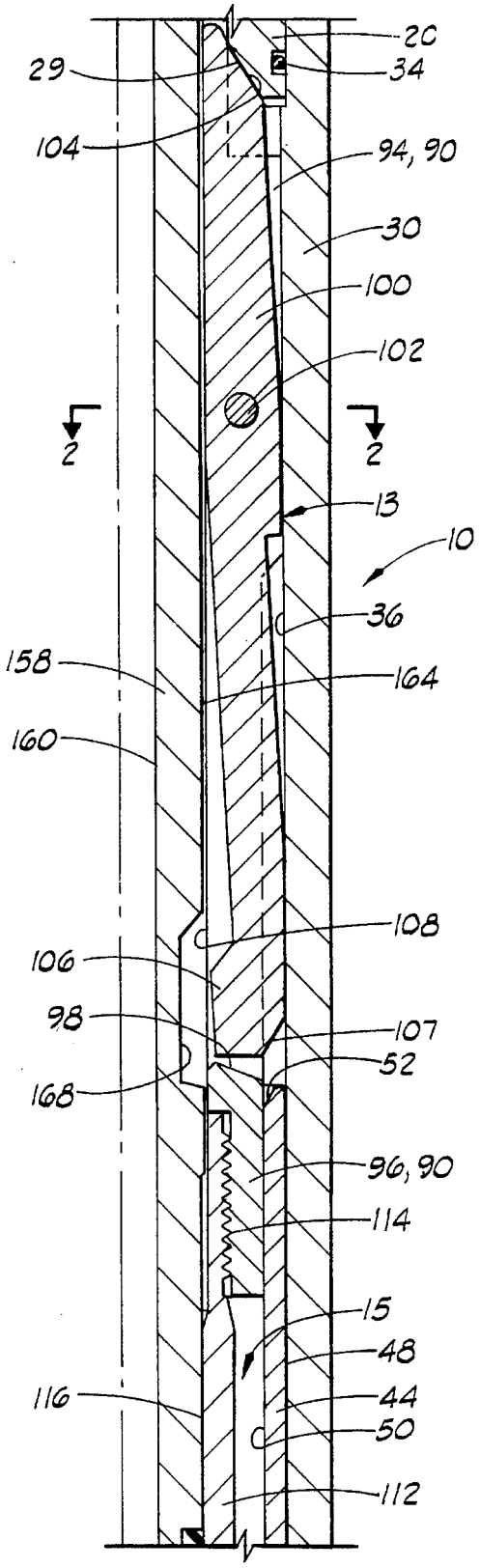
Figure 1C:
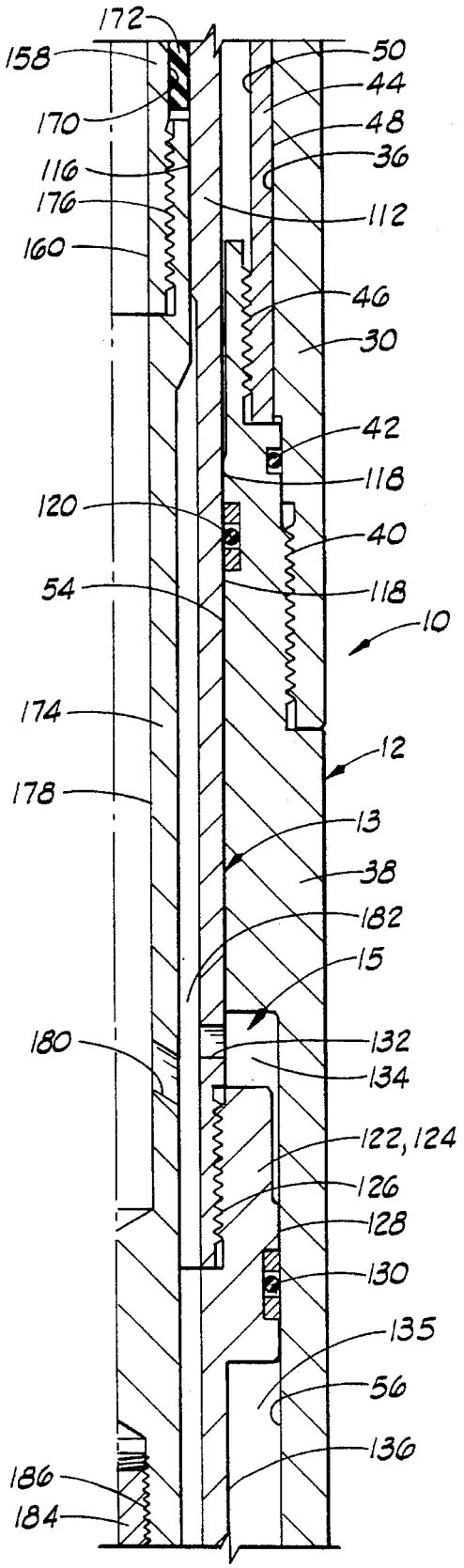
Figure 1D:
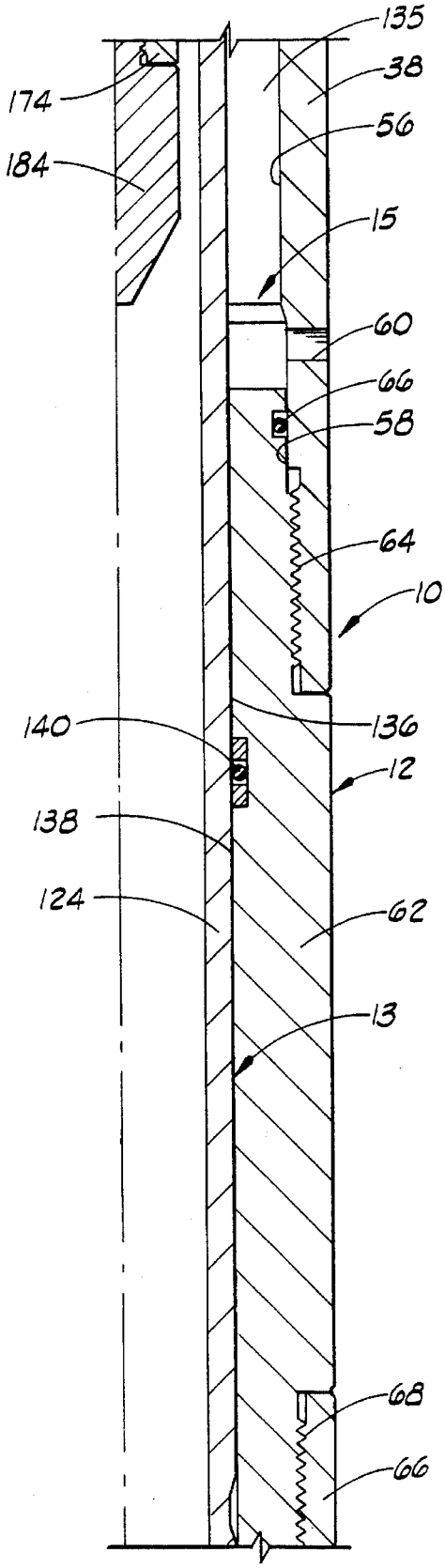
Figure 1E:
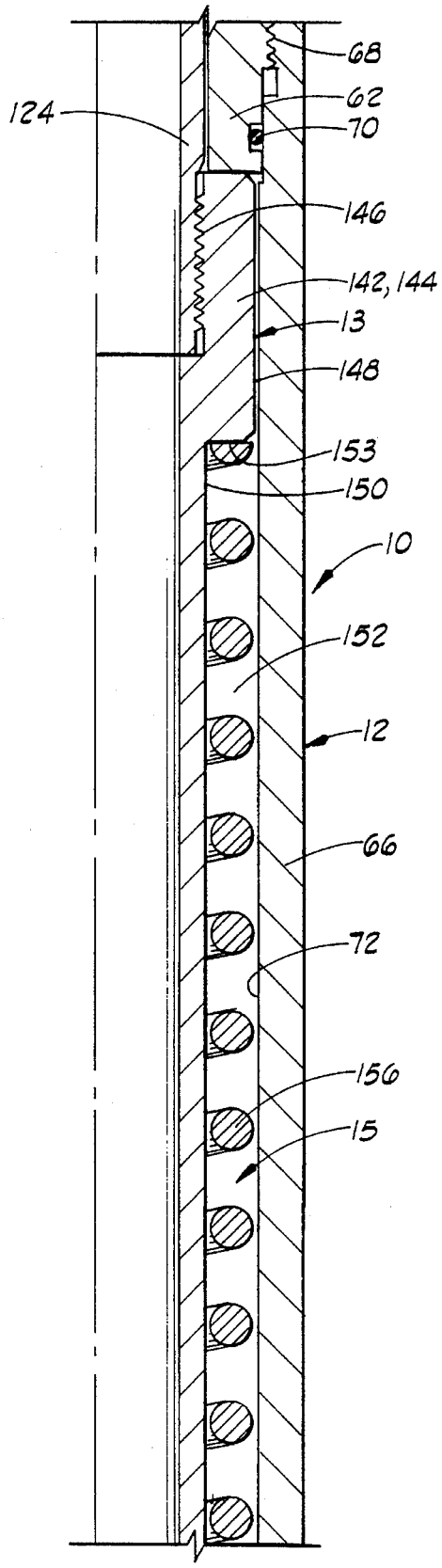
Figure 1F:
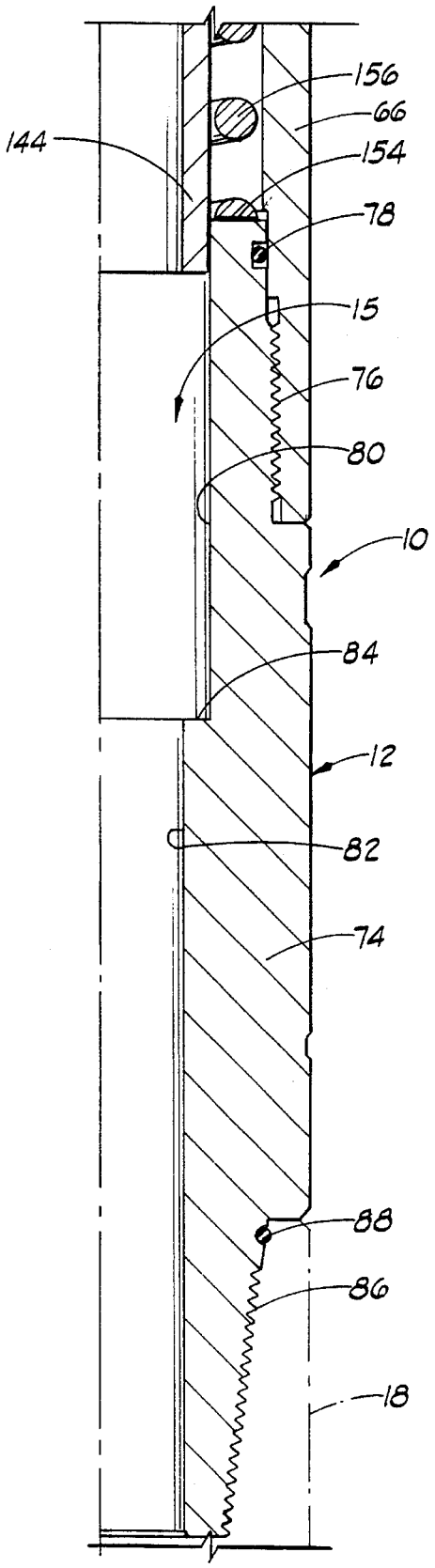

Latch housing 12 is run in as a portion of the drill pipe workstring and is connected at its upper end to an upper drill pipe portion 16 as shown in FIG. 1A and at its lower end to a lower drill pipe portion or tool string 18 as shown in FIG. 1F.

Referring again to FIG. 1A, at the upper end of latch housing 12 is a top adapter 20 having an internal thread 22 which connects to upper drill pipe portion 16. The top adapter defines a first bore 24 therein with a larger second bore 26, such that a downwardly facing shoulder 28 extends between the first and second bores. First bore 24 and second bore 26 are part of central opening 15. At the bottom of top adapter 20 is a downwardly facing chamfer 29 as seen in FIG. 1B.

The lower end of top adapter 20 is attached to a mandrel case 30 at threaded connection 32. Referring again to FIG. 1B, a sealing means, such as O-ring 34, provides sealing engagement between top adapter 20 and mandrel case 30. Mandrel case 30 defines a longitudinal bore 36 therethrough forming part of central opening 15.

Referring now to FIG. 1C, the lower end of mandrel case 30 is attached to a pressure balance piston case 38 at threaded connection 40. A sealing means, such as O-ring 42, provides sealing engagement therebetween.

A latch finger sleeve 44 is attached to piston case 38 at threaded connection 46 and extends upwardly into mandrel case 30. Latch finger sleeve 44 has an outside diameter 48 adapted to fit closely within bore 36 in mandrel case 30. Latch finger sleeve 44 defines a bore 50 therein. Bore 50 is thus part of central opening 15. Referring again to FIG. 1B, at the upper end of bore 50 is an upwardly and inwardly facing chamfer 52.

Piston case 38 defines a first bore 54 and a larger second bore 56 therein as seen in FIG. 1C, both of which form part of central opening 15. Referring also to FIG. 1D, piston case 38 also has a third bore 58 therein. A piston case port 60 is defined transversely through piston case 38, thus providing communication between the interior and exterior of the piston case.

The lower end of piston case 38 is attached to a piston nipple 62 at threaded connection 64. A sealing means, such as O-ring 66, provides sealing engagement between piston nipple 62 and third bore 58 of piston case 38.

Referring now to FIGS. 1D and 1E, the lower end of piston nipple 62 is attached to a spring case 66 at threaded connection 68. A sealing means, such as O-ring 70, provides sealing engagement between spring case 66 and piston nipple 62. Spring case 66 defines a-bore 72 therethrough which is another part of central opening 15.

The lower end of spring case 66 is attached to a bottom adapter 74 at threaded connection 76. See FIG. 1F. A sealing means, such as O-ring 78, provides sealing engagement between bottom adapter 74 and spring case 66.

It will be seen that latch housing 12 thus comprises top adapter 20, mandrel case 30, piston case 38, piston nipple 62, spring case 66 and bottom adapter 74.

Bottom adapter 74 defines a first bore 80 and a smaller second bore 82 therein which are portions of central opening 15. An upwardly facing annular shoulder 84 extends between first bore 80 and second bore 82.

An external thread 86 on the lower end of bottom adapter 74 is adapted for threading engagement with lower drill pipe portion or tool string 18 and a sealing means, such as O-ring 88, is provided for sealing between bottom adapter 74 and lower drill pipe portion 18.

Referring again to FIGS. 1A and 1B, the upper end of mandrel assembly 13 includes a latch finger mandrel 90 which is disposed in latch housing 12. An upper portion 92 of latch finger mandrel 90 is slidably positioned in second bore 26 of top adapter 20, and an upper end of the latch mandrel is adjacent to shoulder 28 when in the initial position shown in FIGS. 1A–1F. An intermediate portion 94 of latch finger mandrel 90 is slidably positioned in bore 36 of mandrel case 30, and a lower portion 96 of the latch mandrel is slidably disposed in bore 50 of latch finger sleeve 44.

Figure 2:
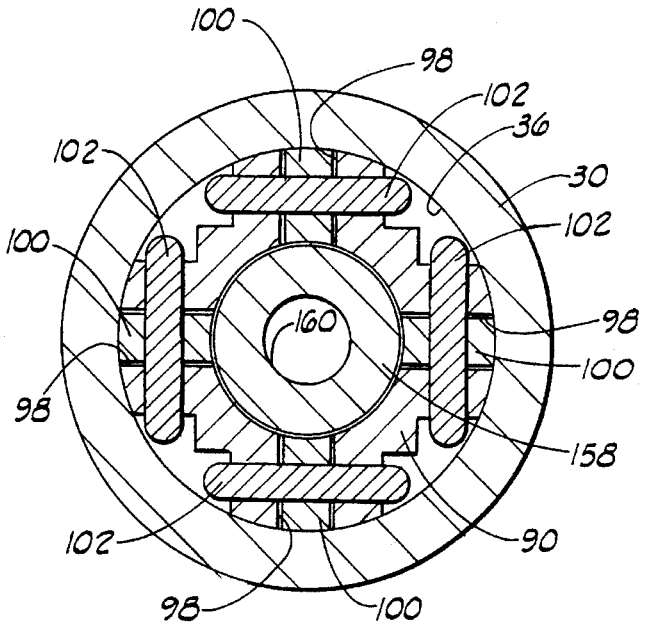
FIG. 2 is a cross section taken along lines 2—2 in FIG. 1B.
Figure 3A:
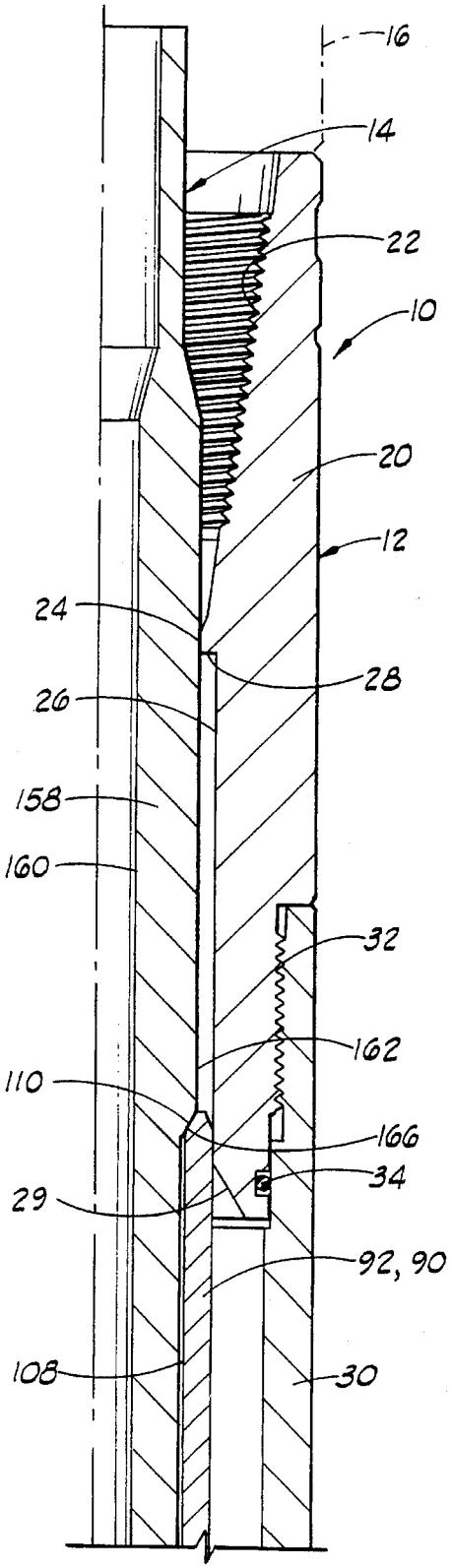
FIGS. 3A–3F present a longitudinal cross section of the downhole coiled tubing latch of the present invention shown in an engaged or latched position.
Figure 3B:
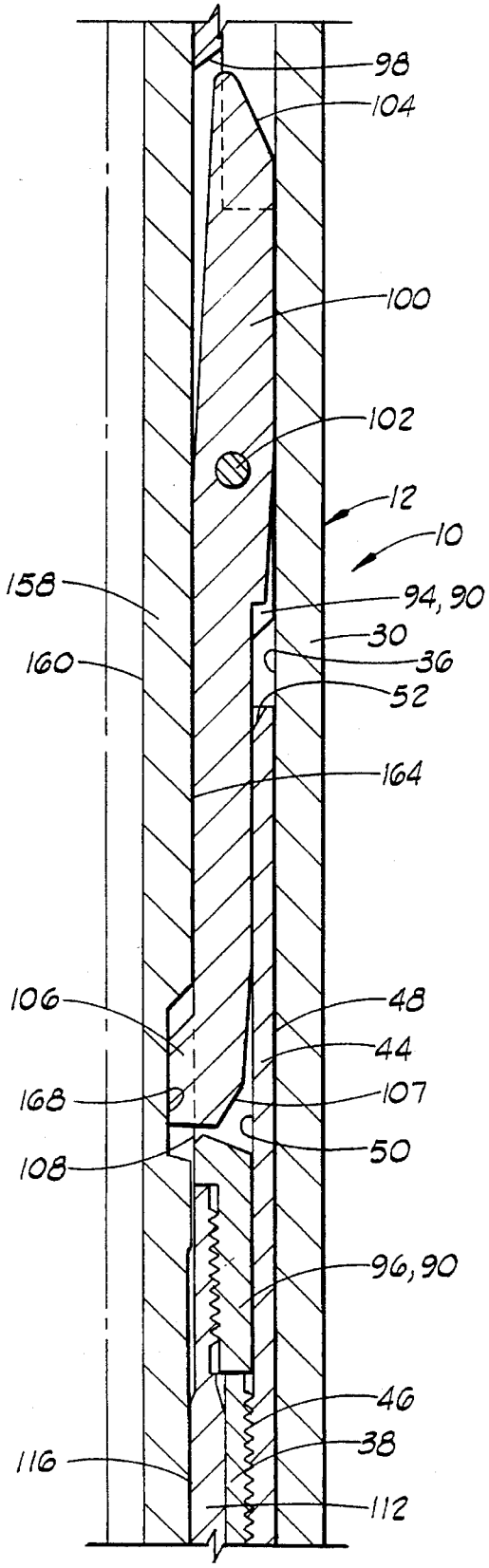
Figure 3C:
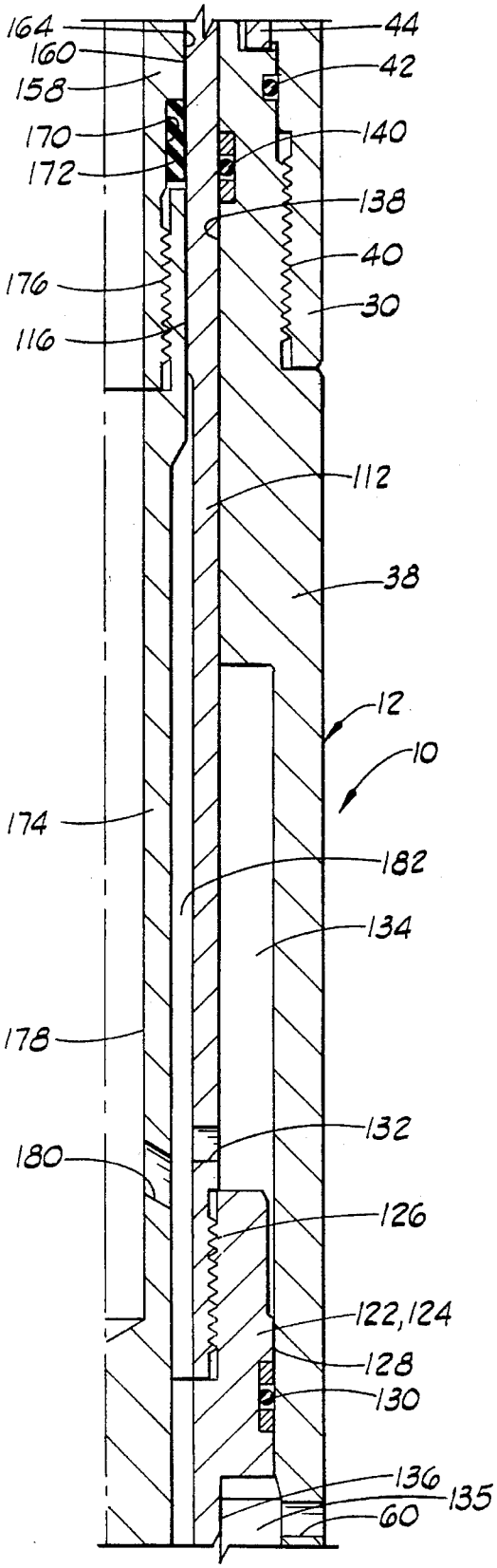
Figure 3D:
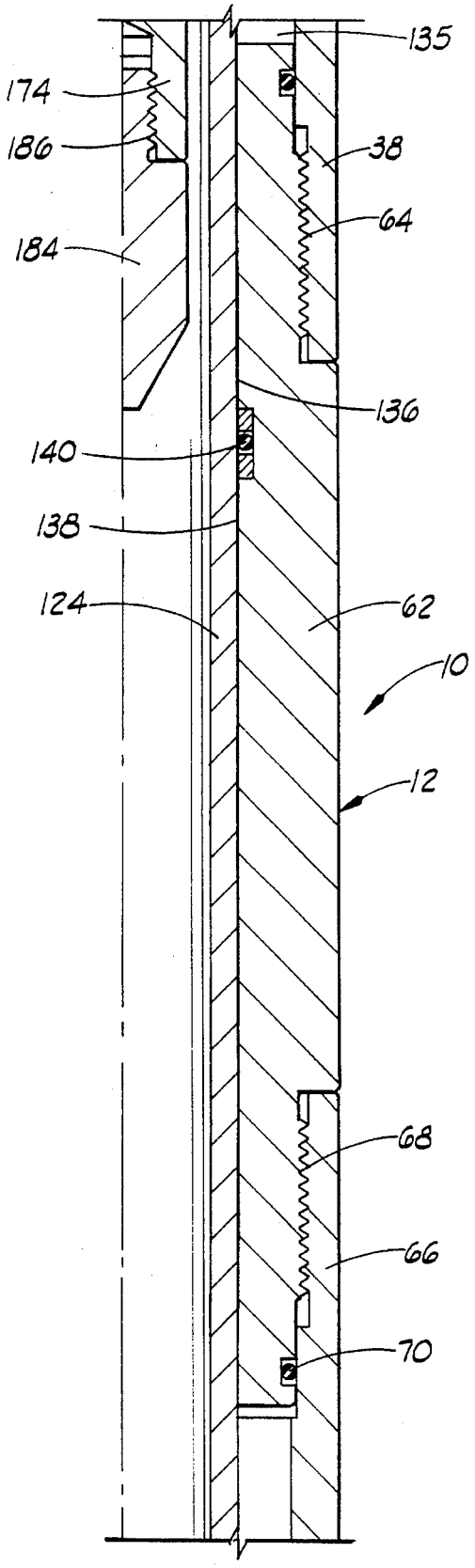
Figure 3E:
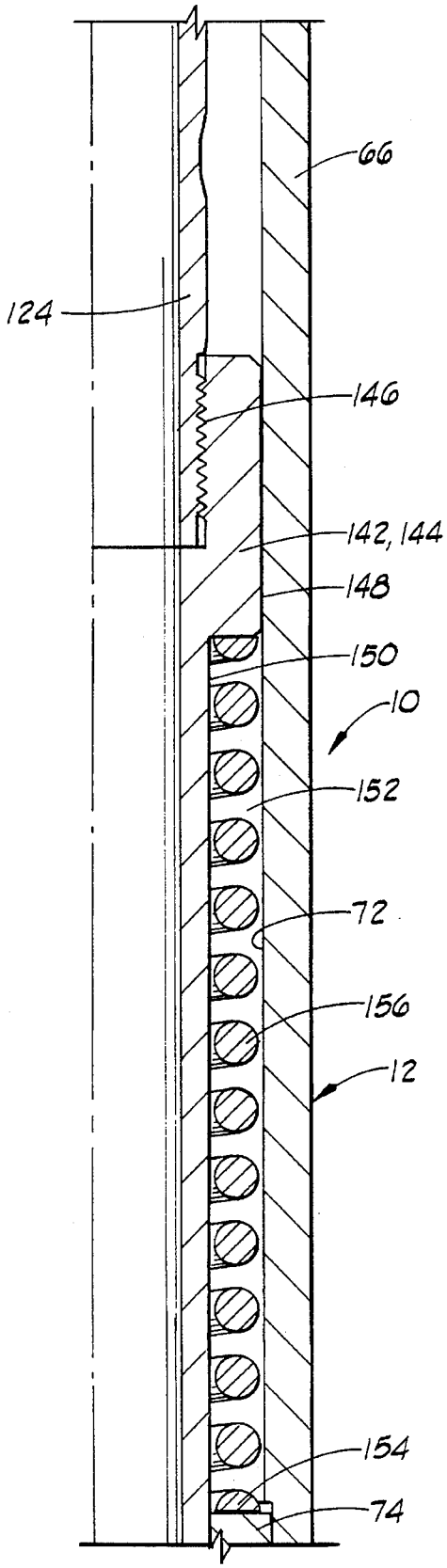
Figure 3F:
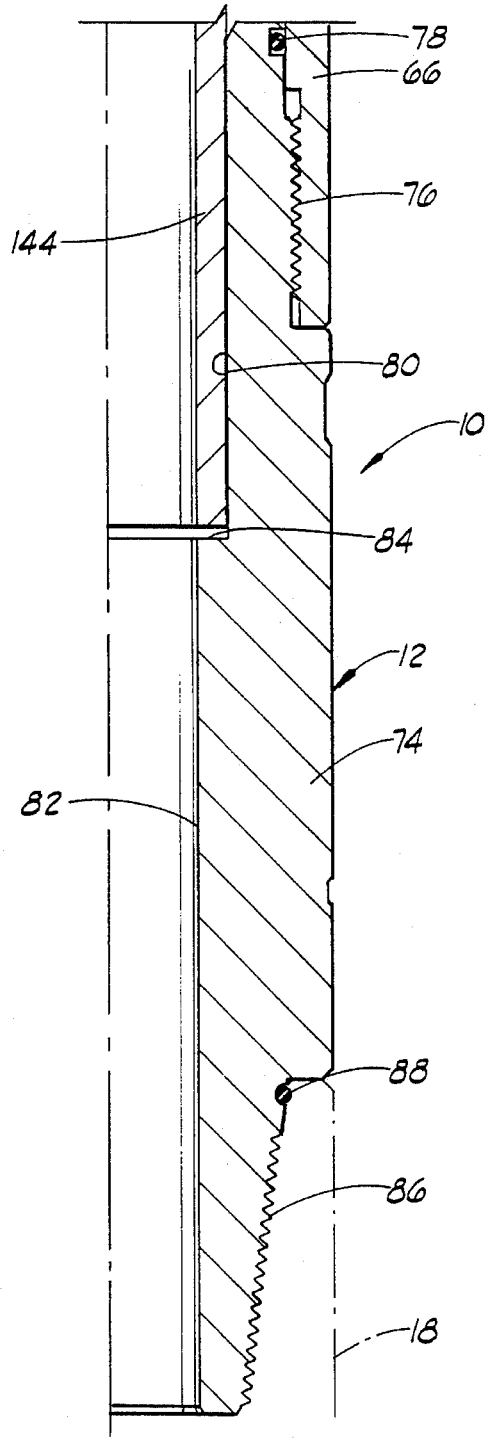

Latch finger mandrel 90 defines a plurality of apertures 98 therein, as best seen in FIGS. 1B and 2. Apertures 98 are angularly spaced around a central axis of apparatus 10. A latch finger 100 is disposed in each aperture 98, and each latch finger is pivotally mounted on a pivot pin 102. As seen in FIG. 1B, each latch finger 100 may pivot in a generally radially oriented plane.

At the upper end of each latch finger 100 is an outwardly facing chamfer 104 which abuts chamfer 29 in top adapter 20 when in the position shown in FIGS. 1A–1F. At the lower end of each latch finger 100 is a radially inwardly directed lug 106 and an outwardly and downwardly facing chamfer 107. When in the initial position shown in FIG. 1B, all of lug 106 is disposed radially outwardly of bore 108 in latch finger mandrel 90.

At the upper end of upper portion 92 of latch finger mandrel 90 is a inwardly facing chamfer 110. Chamfer 110 extends radially outwardly from bore 108 in latch finger mandrel 90.

Lower portion 96 of latch finger mandrel 90 is attached to a latch seal mandrel 112 at threaded connection 114. See FIG. 1B. Latch seal mandrel 112 defines a seal bore 116 therein.

Referring again to FIG. 1C, latch seal mandrel 112 has an outside diameter 118 slidably received in bore 54 of piston case 38. A sealing means, such as seal assembly 120, provides sliding, sealing engagement between piston case 30 and latch seal mandrel 112.

The lower end of latch seal mandrel 112 is attached to an enlarged upper portion 122 of a pressure balance piston 124 at threaded connection 126. Piston 124 has a first outside diameter 128 adapted for sliding within second bore 56 of piston case 38. A sealing means, such as seal assembly 130, provides sliding, sealing engagement between piston 124 and piston case 38.

The lower end of latch seal mandrel 112 also defines a latch seal mandrel port 132 transversely therethrough. It will be seen that latch seal mandrel port 132 provides communication between the interior of latch seal mandrel 112 and second bore 56 in piston case 38 above upper portion 122 of pressure balance piston 124. Stated in another way, port 132 provides communication between the interior of latch seal mandrel 112 and an annulus 134 above seal assembly 130.

Referring to FIGS. 1C and 1D, another annulus 135 is defined between piston case 38 and pressure balance piston 124 below upper portion 122 of the pressure balance piston. It will be seen that piston case port 60 provides communication between annulus 135 and the exterior of apparatus 10.

Pressure balance piston 124 has a second outside diameter 136 which extends downwardly through piston nipple 62 and is slidably received in bore 138 in the piston nipple. A sealing means, such as seal assembly 140, provides sliding, sealing engagement between piston nipple 62 and second outside diameter 136 of pressure balance piston 124. Seal assembly 140 thus seals at the lower end of annulus 135.

Referring now to FIG. 1E, the lower end of pressure balance piston 124 is attached to an enlarged upper portion 142 of a spring mandrel 144 at threaded connection 146. Spring mandrel 144 has a first outside diameter 148 and a smaller second outside diameter 150. A downwardly facing shoulder 153 extends between first outside diameter 148 and second outside diameter 150. It will be seen that an annulus 152 is defined radially between second outside diameter 150 of spring mandrel 144 and bore 72 in spring case 66 and longitudinally between shoulder 153 on the spring mandrel and upper end 154 of bottom adapter 74. See FIGS. 1E and 1F. The lower end of spring mandrel 44 is slidably received in first bore 80 of bottom adapter 74.

Mandrel assembly 13 thus comprises latch finger mandrel 90, latch fingers 100, latch seal mandrel 112, pressure balance piston 124 and spring mandrel 144.

A biasing means, such as spring 156, is disposed in annulus 152. Spring 156 bears against upper end 154 of lower adapter 74 and shoulder 153 of spring mandrel 144 so that mandrel assembly 13 is biased upwardly within central opening 15 of latch housing 12.

The details of latch stinger 14 will now be discussed. Referring again to FIG. 1A, the upper end of latch stinger 14 comprises a latching mandrel 158 defining a bore 160 therethrough. Latching mandrel 158 is preferably adapted for connection to a coiled tubing string (not shown), although the invention is not intended to be so limited. Latching mandrel 158 has a first outside diameter 162 and a smaller, second outside diameter 164 thereon. A downwardly facing chamfer 166 extends between first outside diameter 162 and second outside diameter 164 on latching mandrel 158. As will be further discussed herein, chamfer 166 is adapted for engagement with chamfer 110 on upper portion 92 of latch finger mandrel 90.

Referring now to FIG. 1B, latching mandrel 158 defines an annular latching groove 168 which is longitudinally aligned with lugs 106 on each of latch fingers 100. As best seen in FIG. 1C, latching mandrel 158 has a third outside diameter 170 thereon. A sealing means, such as latch seal 172, is disposed on third outside diameter 170 of latching mandrel 58 and is adapted for sealing engagement with seal bore 116 in latch seal mandrel 112.

Below latch seal 172 latching mandrel 158 is attached to a ported stinger mandrel 174 at threaded connection 176. Ported stinger mandrel 174 defines a bore 178 therein which is in communication with bore 160 in latching mandrel 158. A port 180 is defined in ported stinger mandrel 174 and provides communication between bore 178 therein and an annulus 182 defined between ported stinger mandrel 174, latch seal mandrel 112 and pressure balance piston 124.

Referring to FIGS. 1C and 1D, a stinger nose 184 is attached to the lower end of ported stinger mandrel 174 at threaded connection 186.

Latch stinger 14 thus comprises latching mandrel 158, ported stinger mandrel 174 and stinger nose 184.

OPERATION OF THE FIRST EMBODIMENT

Referring to FIGS. 1A–1F and 3A–3F, the operation of the first embodiment will be described.

Latch housing 12 is made up as part of a drill pipe string between upper drill pipe portion 16 and lower drill pipe portion 18. This drill pipe string is positioned in a well bore.

When it is desired to pump fluids down the drill pipe, latch stinger 14 is lowered on coiled tubing. Latching mandrel 158 is connected to the coiled tubing in a manner known in the art.

Stinger nose 184 guides latch stinger 14 into central opening 15 of latch housing 12. Latch stinger 14 is lowered until chamfer 166 on latching mandrel 158 engages chamfer 110 in upper portion 92 of latch finger mandrel 90. In this position, latching groove 168 is aligned longitudinally with lugs 160 on each of latch fingers 100, as previously mentioned.

Weight is set down on the coiled tubing string, and thus latch stinger 14, which is sufficient to overcome the force exerted by spring 156 so that mandrel assembly 13 and latch stinger 14 are moved downwardly. As latch finger mandrel 90 of mandrel assembly is thus moved downwardly with respect to latch housing 12, chamfer 107 on each of latch fingers 100 engages chamfer 52 in latch finger sleeve 44 which forces the lower end of each latch finger radially inwardly, pivoting about pivot pin 102. Lugs 106 on latch fingers 100 are moved into latching engagement with latching groove 168 in latching mandrel 158. Latch stinger 14 and mandrel assembly 13 are therefore moved downwardly as a positively latched unit as weight is set down. This downward movement causes compression of spring 156. As pressure balance piston 124 is moved downwardly, fluid in annulus 135 below upper portion 122 is displaced outwardly through piston case port 60 into the well annulus.

It will be understood that, as latch stinger 14 is lowered into position with respect to mandrel assembly 13, as previously described, latch seal 172 is moved into sealing engagement with seal bore 116 in latch seal mandrel 112. After latch stinger 14 and mandrel assembly 13 are latched together and moved downwardly, fluid may be pumped down the coiled tubing string into the latched stinger. This fluid is pumped through bore 160 in latching mandrel 158 and bore 178 in ported stinger mandrel 174. The fluid flows out of ports 180 in ported stinger mandrel 184 into annulus 182 and downwardly through latch housing 12. The resulting pressure differential results in a downward force on latch stinger 14.

Because of the fluid communication between bore 178 in ported stinger mandrel 174 and annulus 134 by means of port 180, annulus 182 and mandrel port 132, fluid pressure is also applied to annulus 134. The resulting pressure differential causes a downward force to act on upper portion 122 of pressure balance piston 124.

These downwardly acting pressure differentials help hold mandrel assembly 13 and latch stinger 14 in their downward position while fluid is being pumped. That is, the pumping of fluid will not tend to pump mandrel assembly 13 and latch stinger 14 out of latch housing 12.

It will be seen by those skilled in the art that as long as weight is applied on the coiled tubing, latch stinger 14 will remain latchingly engaged with mandrel assembly 13 and thus with latch housing 12 so that the components cannot disengage. This latching insures constant sealing engagement by latch seal 172 with seal bore 116 in latch seal mandrel 112.

When pressure is relieved, the coiled tubing string is picked up so that weight is no longer applied on latch stinger 14 and mandrel assembly 13. Spring 156 moves mandrel assembly 13 and latch stinger 14, which is still latched to the mandrel assembly, upwardly.

Eventually, this upward movement results in chamfer 104 at the upper end of each of latch fingers 100 being engaged with chamfer 29 in top adapter 20 which forces the upper end of the latch fingers to pivot radially inwardly. The lower end of each latch finger 100 is thus moved radially outwardly to disengage lugs 106 from latching groove 168. At this point, latch stinger 14 may be removed from latch housing 12.

This procedure may be repeated as many times as desired.

DESCRIPTION OF THE ALTERNATE EMBODIMENT

Referring now to the drawings, and more particularly, to FIGS. 4A–4G, an alternate embodiment of the downhole coiled tubing latch of the present invention is shown and generally designated by the numeral 200.

Apparatus 200 generally comprises a latch housing 202 with a central opening 201 therein and the same latch stinger 14 previously described for the first embodiment. A mandrel assembly 203 is disposed in central opening 201 of latch housing 202. Latch housing 202 is made up as part of a drill pipe string which includes upper drill pipe portion 16 and lower drill pipe portion or tool string 18 as in the first embodiment. Latch housing 202 includes the same components as latch housing 12 of the first embodiment with some additional components added. Therefore, the same reference numerals previously used for the first embodiment are used for the identical components in alternate embodiment 200.

At the upper end of latch housing 202 is top adapter 20 which is connected to mandrel case 30. Latch housing 12 also includes piston case 38 attached to the lower end of mandrel case 30 and piston nipple 62 which is attached to the lower end of piston case 38, all as previously described.

However, in alternate embodiment 200, the lower end of piston nipple 62 is attached to an auxiliary pressure balance piston case 204 at threaded connection 206. A sealing means, such as O-ring 208, provides sealing engagement between piston nipple 62 and auxiliary pressure balance piston case 204. Auxiliary pressure balance piston case 204 defines a first bore 210 and a smaller second bore 212 therein which are parts of central opening 201. A case port 214 is defined transversely through auxiliary pressure balance piston case 204 and provides communication between first bore 210 and the exterior of apparatus 200.

Figure 4A:
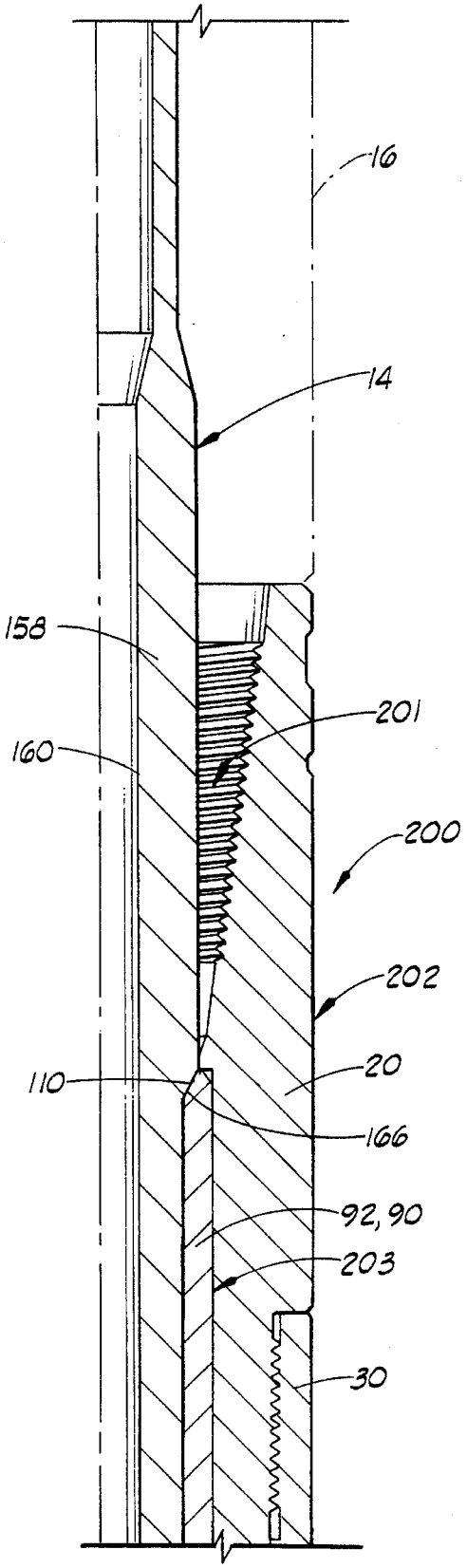
FIGS. 4A–4G show a longitudinal cross section of an alternate embodiment of the present invention.
Figure 4B:
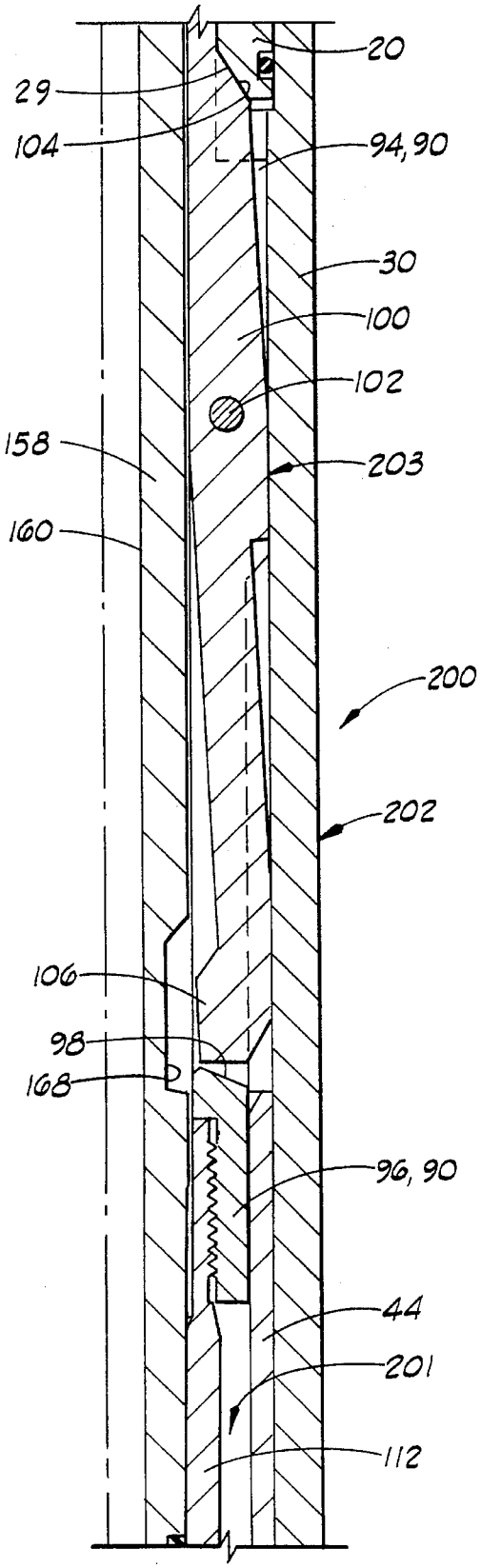
Figure 4C:
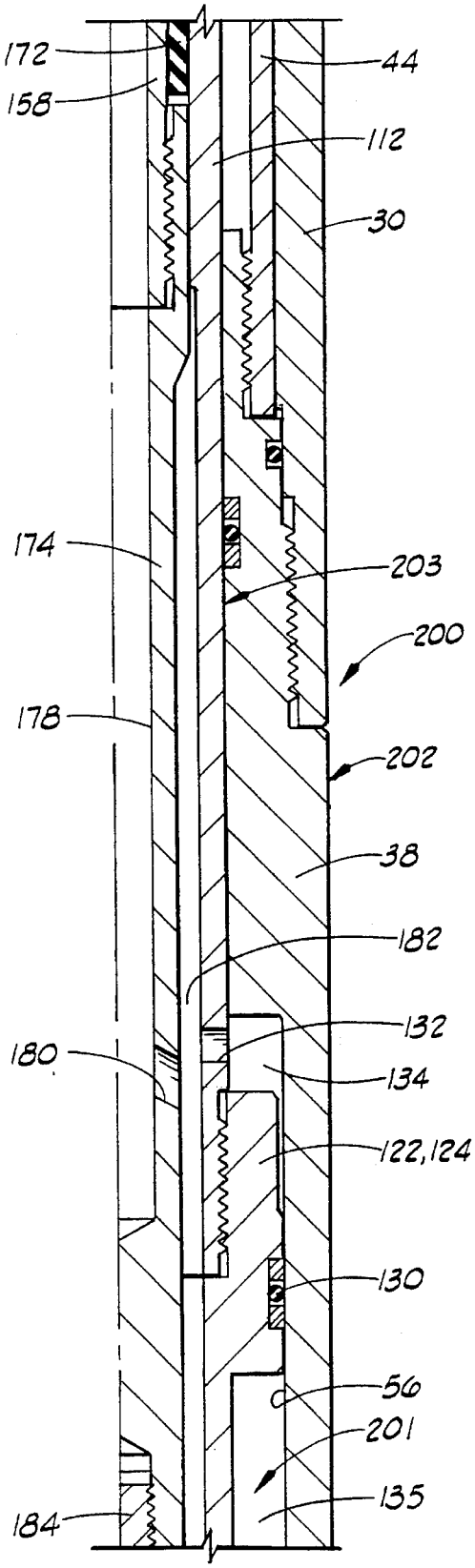
Figure 4D:
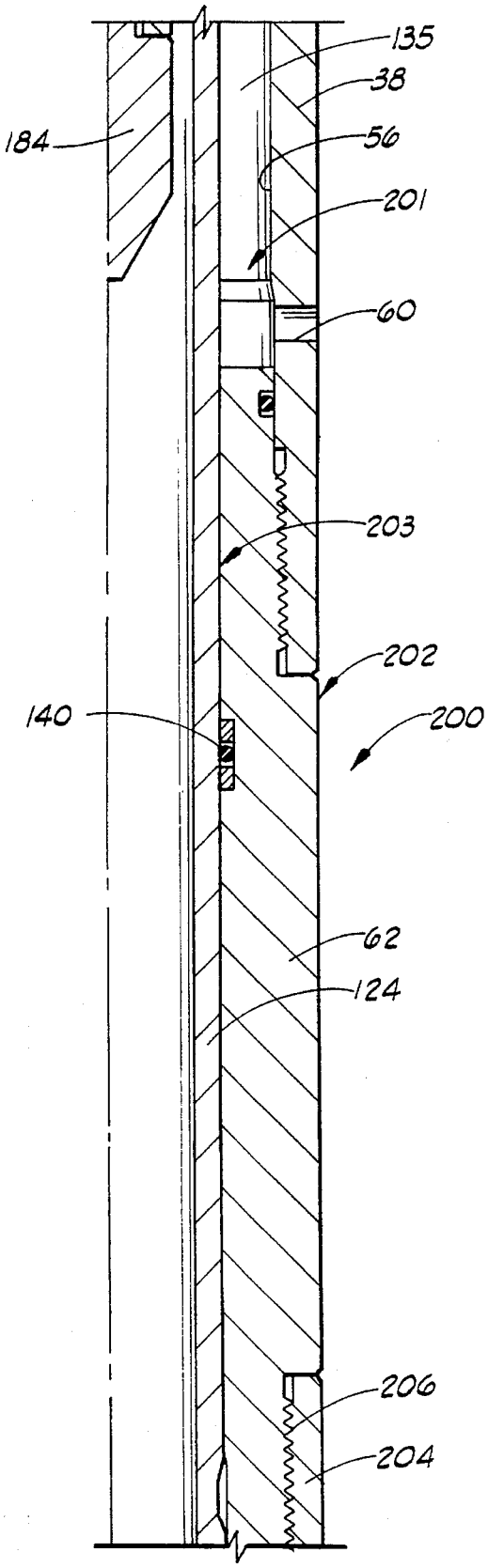
Figure 4E:
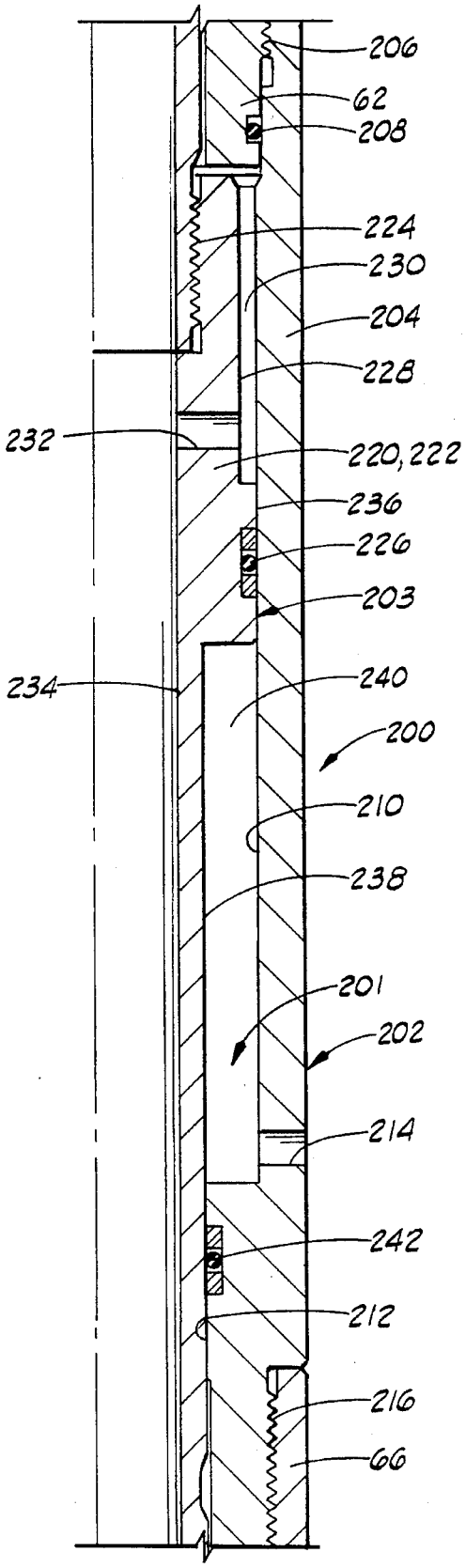
Figure 4F:
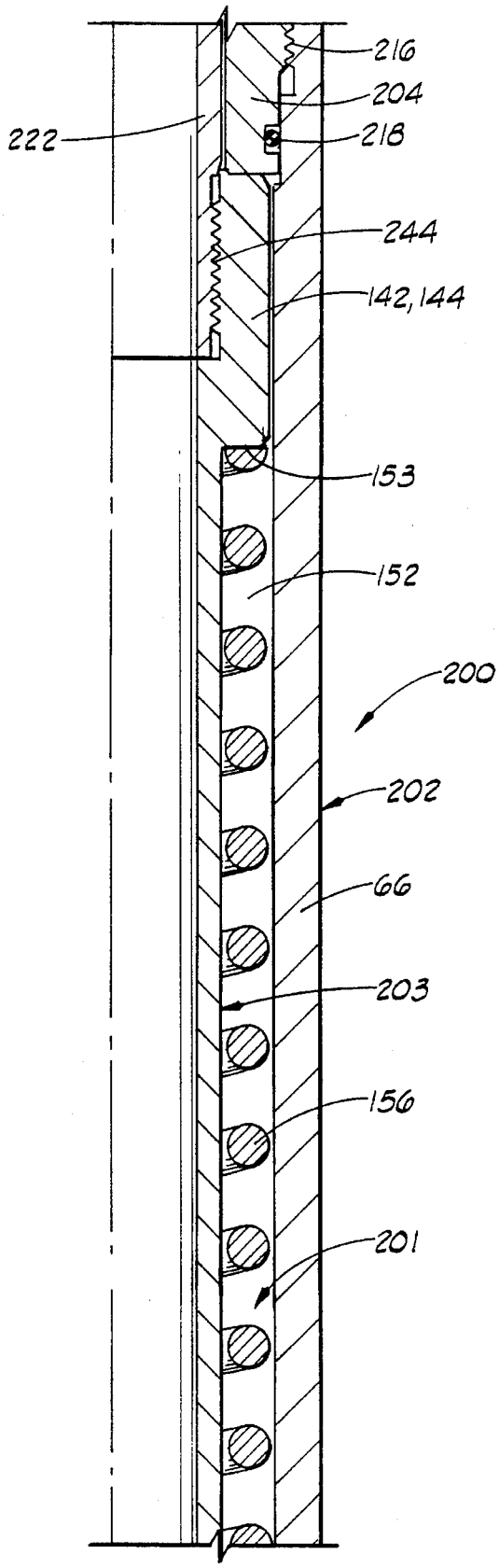
Figure 4G:
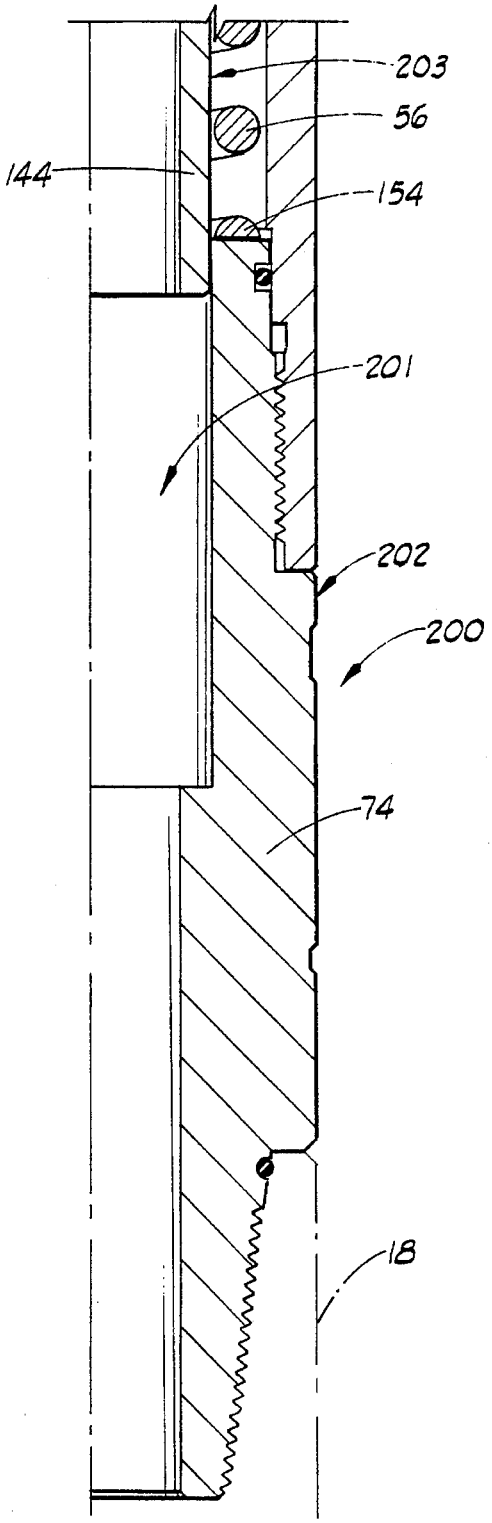

The lower end of auxiliary pressure balance piston case 204 is attached to the upper end of spring case 66 at threaded connection 216. Referring also to FIG. 4F, a sealing means, such as O-ring 218, provides sealing engagement between auxiliary pressure balance piston case 204 and spring case 66.

Mandrel assembly 203 in alternate embodiment 200 includes the same components as mandrel assembly 13 in first embodiment 10 along with some additional components. The same reference numerals will be used for the identical components.

Thus, at the upper end of mandrel assembly 203 is latch finger mandrel 90 which includes a plurality of latch fingers 100 pivotally disposed on pivot pins 102 therein. Lower portion 96 of latch finger mandrel 90 is connected to latch seal mandrel 112 which supports latch seal 172 as previously described, and the lower end of latch seal mandrel 112 is connected to pressure balance piston 124.

However, referring again to FIG. 4E, the lower end of pressure balance piston 124 is attached to an enlarged upper portion 220 of an auxiliary pressure balance piston 222 at threaded connection 224. A sealing means, such as seal assembly 226, provides sliding, sealing engagement between auxiliary pressure balance piston 222 and first bore 210 in auxiliary pressure balance piston case 204.

Auxiliary pressure balance piston 222 has a first outside diameter 228 which is spaced inwardly from first bore 210 in auxiliary pressure balance piston case 204 such that an annulus 230 is defined therebetween. A piston port 232 is defined transversely through auxiliary pressure balance piston 222 to provide communication between annulus 230 and a bore 234 through the auxiliary pressure balance piston.

Auxiliary pressure balance piston 222 also has a second outside diameter 236 and a smaller third outside diameter 238 which is spaced inwardly from first bore 210 in auxiliary pressure balance piston case 204 such that an annulus 240 is defined below upper portion 220 of the auxiliary pressure balance piston and is in communication with case port 214. It will be seen by those skilled in the art that seal assembly 226 sealingly separates annulus 230 and annulus 240. Another sealing means, such as seal assembly 242, provides sliding, sealing engagement between auxiliary pressure balance piston case 204 and third outside diameter 238 of auxiliary pressure balance piston 222. Thus, seal assembly 242 seals the lower portion of annulus 240.

Referring again to FIG. 4F, the lower end of auxiliary pressure balance piston 222 is attached to enlarged upper portion 142 of spring mandrel 144 at threaded connection 244. Spring mandrel 144 extends downwardly into bottom adapter 74 as in the first embodiment, and spring 156 is included in a manner substantially identical to the first embodiment.

OPERATION OF THE ALTERNATE EMBODIMENT

Operation of alternate embodiment 200 is substantially the same as that previously described for first embodiment 10. That is, weight is set down on the coiled tubing to latchingly engage latch stinger 14 with mandrel assembly 203. As mandrel assembly 203 is moved downwardly, fluid in annulus 135 is displaced through piston case port 60 into the well annulus, and fluid is similarly displaced outwardly from annulus 240 through case port 214.

In addition to the action previously described, when fluid is pumped through latch stinger 14, pressure is also applied to annulus 230 on top of auxiliary pressure balance piston 222 through piston port 232. This provides an additional downwardly acting force on auxiliary pressure balance piston 222 which aids in holding mandrel assembly 203 and latch stinger 14 in the downward position and preventing them from being pumped upwardly through latch housing 202.

When pressure is relieved, weight may be picked up on the coiled tubing which allows spring 156 to return mandrel assembly 203 and latch stinger 14 to the original, unlatched position shown in FIGS. 4A–4G.

Thus, alternate embodiment 200 operates in substantially the same manner as first embodiment 10 but provides additional downward force for holding mandrel assembly 203 and latch stinger 14 in the downward, latched position while fluid is pumped.

It will be seen, therefore, that the downhole coiled tubing latch of the present invention is well adapted to attain the ends and advantages mentioned as well as those inherent therein. While presently preferred embodiments of the apparatus have been described for purposes of this disclosure, numerous changes in the arrangement and construction of parts may be made by those skilled in the art. All such changes are encompassed within the scope and spirit of the appended claims.

What is claimed is:

1. A downhole apparatus comprising:

housing means for connecting to a drill pipe;

a mandrel slidably disposed in said housing means;

stinger means for positioning in said housing means and allowing pumping of fluid therethrough; and latching means for latching said stinger means to said housing means when said stinger means is moved downwardly in said housing means.

2. The apparatus of claim 1 wherein said latching means comprises:

a latch finger pivotally disposed on said mandrel and adapted for latchingly engaging a latching groove on said stinger means.

3. The apparatus of claim 2 wherein said latch finger comprises a lug thereon for extending into said latching groove when in a latching position.

4. The apparatus of claim 2 further comprising biasing means for biasing said mandrel toward an unlatched position.

5. The apparatus of claim 4 wherein said biasing means comprises:

a shoulder on said mandrel;

a shoulder on said housing means; and a spring disposed between said shoulder on said mandrel and said shoulder on said housing means.

6. The apparatus of claim 2 further comprising a piston adapted on said mandrel for providing a downward force on said mandrel when pressure is applied to said piston.

7. The apparatus of claim 6 wherein said piston is in fluid communication with a central opening through said stinger means.

8. The apparatus of claim 2 further comprising sealing means for sealing between said stinger means and said mandrel.

9. The apparatus of claim 1 wherein said stinger means is adapted for attachment to a coiled tubing string.

10. A downhole apparatus comprising:

a housing adapted for positioning in a drill pipe and defining a central opening therethrough;

a mandrel assembly slidably disposed in said housing and defining a mandrel central opening therethrough;

a stinger positionable in said mandrel central opening; and latching means for latchingly engaging said stinger when said stinger is moved downwardly.

11. The apparatus of claim 10 wherein:

said mandrel defines an aperture therein; and said latching means comprises a latch finger pivotally disposed in said aperture.

12. The apparatus of claim 11 wherein:

said stinger defines a latching groove thereon; and said latch finger has a lug thereon adapted for extending into said latching groove when said finger is in the latched position.

13. The apparatus of claim 12 wherein said latch finger is pivoted to said latched position as said mandrel and said stinger are moved axially in one direction in said housing and pivoted to an unlatched position as said mandrel and said stinger are moved axially in an opposite direction in said housing.

14. The apparatus of claim 13 further comprising biasing means for biasing said mandrel toward an unlatched position.

15. The apparatus of claim 14 wherein said biasing means comprises a spring disposed between said housing and said mandrel.

16. The apparatus of claim 14 wherein said latch finger is pivoted to an unlatched position in response to movement of said mandrel resulting from said biasing means.

17. The apparatus of claim 10 wherein said mandrel comprises a piston adapted for exerting a downward force on said mandrel when pressure is applied thereto.

18. The apparatus of claim 17 wherein said piston is one of a plurality of pistons.

19. The apparatus of claim 10 further comprising sealing means for sealing between said stinger and said mandrel when said stinger is disposed in said mandrel.

20. The apparatus of claim 10 wherein said stinger is adapted for connection to a coiled tubing string.

21. A method of pumping fluid into a drill pipe comprising the steps of:

positioning a latch housing with a slidable latch mandrel therein in a drill pipe in a well bore;

positioning a stinger in said mandrel and latch housing;

setting down weight on said stinger to apply an axial force for moving said stinger and mandrel in said latch housing; and latchingly engaging said mandrel and said stinger in response to said movement.

22. The method of claim 21 further comprising the step of sealing between said stinger and mandrel when said stinger and mandrel are latched.

23. The method of claim 21 further comprising applying fluid pressure to a piston on said mandrel to provide a force on said mandrel for preventing pumping of said mandrel upwardly.

24. The method of claim 21 further comprising the step of biasing said mandrel such that said mandrel and stinger are moved to an unlatched position when weight is picked up on said stinger.

* * * * *